United States Patent [19]

Henning et al.

[11] 4,218,408

[45] Aug. 19, 1980

[54] COOLING TOWER WITH RIPPLE PLATES

[75] Inventors: Herbert Henning, Velbert; Siegfried Kliemann, Bochum, both of Fed. Rep. of Germany

[73] Assignee: Balcke-Dürr Aktiengesellschaft, Ratingen, Fed. Rep. of Germany

[21] Appl. No.: 913,029

[22] Filed: Jun. 6, 1978

Related U.S. Application Data

[63] Continuation-in-part of Ser. No. 763,022, Jan. 27, 1977, abandoned.

[30] Foreign Application Priority Data

May 5, 1976 [DE] Fed. Rep. of Germany ..... 2619407

[51] Int. Cl.[2] ..... F28F 25/08; F28C 1/02

[52] U.S. Cl. ..... 261/112; 261/DIG. 11

[58] Field of Search ..... 261/112, DIG. 11; 165/DIG. 1; 55/240, 241, 440

[56] References Cited

U.S. PATENT DOCUMENTS

| | | | |
|---|---|---|---|
| 1,803,854 | 5/1931 | Kniskern | 55/355 |
| 2,180,586 | 11/1939 | Gustafsson | 261/112 |
| 2,573,491 | 10/1951 | Richardson | 261/112 |
| 2,836,405 | 5/1958 | Hamon | 261/DIG. 11 |
| 3,115,534 | 12/1963 | Bottner | 261/DIG. 11 |
| 3,133,802 | 5/1964 | Phillips et al. | 55/440 |
| 3,214,348 | 10/1965 | Lichtenstein | 261/112 |
| 3,500,615 | 3/1970 | Meek | 261/112 |
| 3,792,841 | 2/1974 | Munters | 261/112 |
| 3,849,095 | 11/1974 | Regehr | 55/440 |

FOREIGN PATENT DOCUMENTS

| | | | |
|---|---|---|---|
| 851189 | 2/1977 | Belgium | 261/DIG. 11 |
| 57020 | 7/1891 | Fed. Rep. of Germany | 261/DIG. 11 |
| 2619407 | 11/1977 | Fed. Rep. of Germany | 261/DIG. 11 |
| 2250776 | 11/1942 | France | 261/DIG. 11 |

*Primary Examiner*—Frank W. Lutter
*Assistant Examiner*—Gregory N. Clements
*Attorney, Agent, or Firm*—Martin A. Farber

[57] ABSTRACT

A cooling tower with corrugated ripple plate for a substantially vertical assembly in wet cooling towers or combined wet-dry cooling towers in counter-flow or cross-flow construction, of which the portion at the upper end, the corrugation and the spacing relative to the respective adjacent equally-formed ripple plates are formed such that cooling water which is distributed from a distribution device above the ripple plate ripples running down on both surfaces of the ripple plates as substantially uniform thickness water films, the latter being collected in water collector channels arranged at the lower ends of the ripple plates and being fed to a cooling water circuit. One water collector channel is attached on the lower edge of the ripple plates on each side thereof for collecting the water adjacent the lower ends of the ripple plates, from which the collected water is fed back to the cooling water circuit to the distributor device.

7 Claims, 7 Drawing Figures

COOLING TOWER WITH RIPPLE PLATES

This is a continuation-in-part to our co-pending application Ser. No. 763,022 which was filed on Jan. 27, 1977, now abandoned.

The present invention relates to a cooling tower with corrugated ripple plates, the latter being built in substantially vertical assembly in wet cooling towers or combined wet-dry cooling towers in counter-flow or cross-flow construction. From a distribution device which is arranged above the ripple plates, cooling water is distributed on the ripple plates, the latter being combined into a packet of plates. The portion at the upper end, the corrugation and the spacing relative to the respective adjacent equally-formed ripple plates are constructed such that cooling water from the distribution device runs rippling down on both surfaces of each ripple plate as a substantially uniform, equal thickness water film. At the lower end the water is collected in water collector channels arranged at the lower ends of the ripple plates and fed from the water collector channels to a cooling water circuit so that it arrives on the ripple plates refreshed via the distribution device.

Ripple plates of the previously described type are known. They are produced of metal or preferably of asbestos cement or synthetic material or plastic, and cooling air flows against them either in counterflow or in cross-flow direction relative to the rippling down flow direction of the cooling water.

Earlier it was customary to allow the water which flows down the ripple plates to drop off in free fall into a water cup or basin disposed under the ripple plate assemblies on the bottom of the cooling tower, whereby a loud noise occurred and the water from the water cup had to be pumped high from there back above the drop and even higher over a large height difference to the water distribution device with a large energy expenditure. For several decades now additional water collectors have been known, which are arranged under the ripple plates and which feed the water which emerges from the lower end of the ripple plates by inclined collector plates. The cooling water is consequently collected above the height of the prior water collector basin which is no longer needed, whereby not only is the operating noise considerably reduced, but rather energy is saved since the pumping head or lift for the cooling water pump is reduced by the water collector channels which are located high.

The known collector plates with the water collector channels were arranged underneath the ripple assemblies as independent separate assemblies, for which particular supporting frames were required. In addition to its constructional expense, the known embodiment has the disadvantage that particularly through the collector plates, pressure drops arise with respect to the cooling air, which can lead to non-uniform flow through the ripple assemblies and consequently to a reduction of the cooling efficiency.

The present invention started out to improve the prior state of the art. It was an object of the present invention to collect the water which runs down on both sides of the ripple plates without large construction expense and furthermore to avoid the development of pressure losses for the cooling air by voluminous water collector devices. Such pressure losses moreover have as a result an increased energy consumption, which indeed is precisely to be avoided with the present invention by a high located water collector system.

It is another object and task of the present invention to avoid the disadvantages of the known state of the art and to provide a cooling tower with a ripple assembly element which can be used for counter flow construction as well as for cross-flow construction and which makes the arrangement of the additional collector surfaces with water collector grooves superfluous.

It is another object and task of the present invention to aid the solution of the above-mentioned task by providing a cooling tower with ripple plates, on the lower end of each ripple plate on each side thereof there being attached or formed thereon, an integral water collector channel which cooperates with adjacent transverse water removal channels. The two water collector channels according to a further feature of the present invention can be arranged offset in height relative to one another. In accordance with the invention, at least one water collector channel of each ripple plate can be formed integrally in one-piece with the ripple plate.

With this proposal in accordance with the present invention, a ripple plate is provided, on the lower end of which the water films which flow down on both sides are collected and are carried away to one or both sides thereof, so that additional separate collector plates with water collector grooves requiring a higher constructional expense as well as causing pressure drops, are unnecessary and can be eliminated. By the arrangement of the water collector channels on both sides of each ripple plate, a reliable collection of all the water is possible, whereby simultaneously it is guaranteed, that the water films runs down the ripple plates up to the collector channels over the entire height of the ripple plate, so that a cooling loss also by a premature dropping off of the water is avoided, since it is known that water dropping off in free fall is cooled considerably poorer than a thin water film which runs off on a ripple plate smoothly. The collected water is maintained as high as possible without dropping lower and is fed therefrom directly back up to the distribution device above the ripple plates. Consequently water head energy is conserved by recycling the rippling or trickling water from as efficiently as high a level as possible. Conservation of pumping energy thus is achieved by collecting the water substantially no lower than the lower edge of the ripple plates and efficiently removing same without dropping substantially lower, from which point the water is pumped to the water distributing device above the plates.

Not only are the water collector channels part of the energy conservation in accordance with the invention by means of a high located water collector system, but also the additional water removal channels are part of the energy conservation of the invention. These water removal channels of the invention which are arranged crosswise to the longitudinal direction of the ripple plates, in connection with the water collector channels replace and make unncessary the water collector basins existing with the known cooling towers.

The ripple assembly elements formed with the ripple plates in accordance with the present invention can be arranged in several layers one under the other, in order to facilitate a stage-like collection of the cooling water particularly with a cross-flow cooling tower. It is also possible to form merely the lower layer of the ripple assemblies by ripple plates in accordance with the present invention, in exchange for which the ripple assembly elements lying thereabove are made of any ripple plates of choice. This arrangement which is particularly advantageous with counter-current cooling towers ensures that the cooling water is safely collected with certainty in the lowermost layer or position of the ripple assemblies and is carried away.

According to a further feature of the invention, the ripple plates which are combined into a ripple assembly element can be carried on both ends by a transverse girder or member, at least one of which is provided with a water removal channel. The ripple assembly element in this case is inclined with respect to the water removal channel, which is formed by a corresponding cross-sectional formation of a transverse member. In this manner there results a particularly simple construction of the supporting structure for the ripple plates.

According to another feature of the invention one of the slanted U-shaped edges of the water removal channel member support one common end of the ripple plates, the latter overlapping this edge dipping into the water removal channel.

Still further advantageously the water collector channels are formed on a maximum crest or trough point of the corrugations on both sides, where the slope thereof is vertically aligned. The advantage of the vertical slope at the collector channel area provides symmetrical-smoothly directed water simultaneously from both sides of each plate at this point at the water collector channels thereat.

With the above and other advantages in view, the present invention will become more clearly understood from the following detailed description of a preferred embodiment of the invention when considered with the accompanying drawings, of which:

Figure 1:
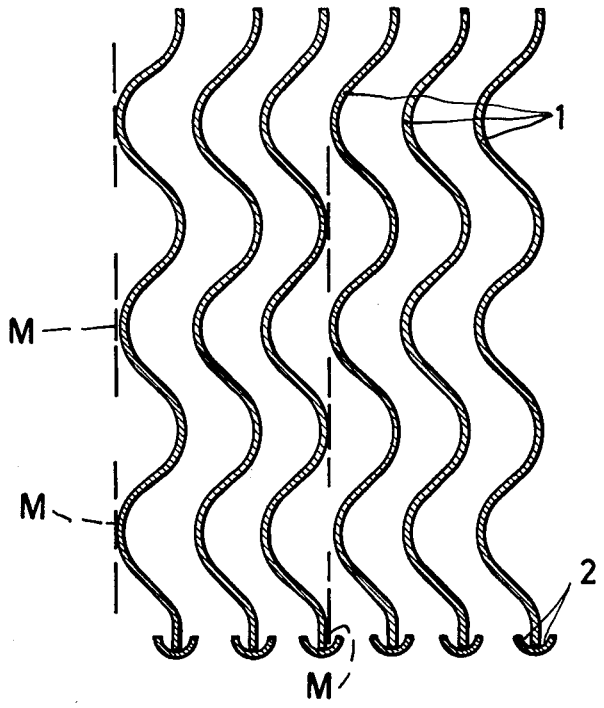
FIG. 1 is a front view of a first embodiment of a ripple plate in accordance with the present invention.
Figure 2:
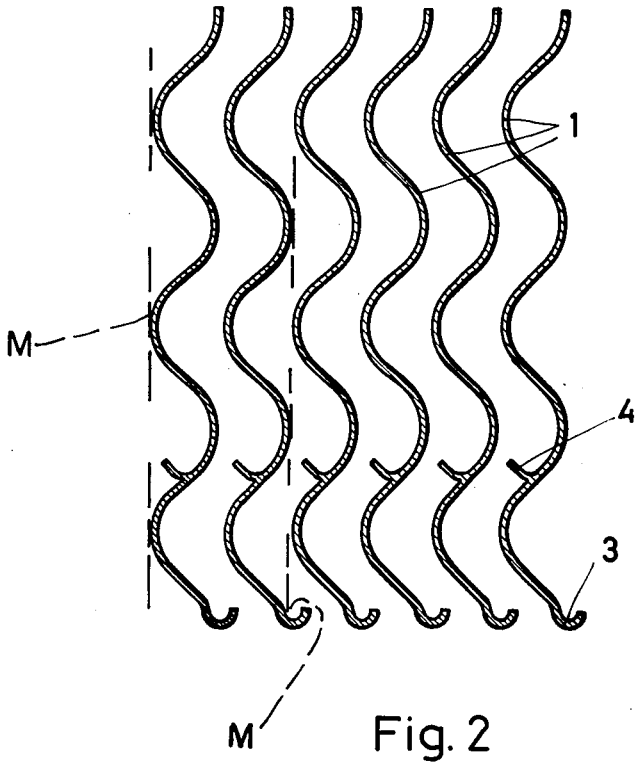
FIG. 2 is a front view of a second embodiment of a ripple plate in accordance with the present invention.

Referring now to the drawings and more particularly to FIGS. 1 and 2, ripple or running film flow plates are illustrated, which ripple plates 1 are corrugated, formed with a plurality of waves comprising crests and troughs, the slope through the maximum points M of which are substantially vertically aligned. The ripple plates 1 extend substantially vertically. The crests and troughs of adjacent ripple plates, respectively, are in phase alignment with each other. The portion at the upper end, the corrugation and the spacing of the ripple plates are formed such that the water which is fed to the ripple plates, which water is distributed above the ripple plates 1 by a distribution device over the ripple assemblies, is distributed on both surfaces of each ripple plate 1 and from there flows down as an approximately equal thickness strength water film, respectively. From these two Figs. it may be recognized that no water drops can fall through between the ripple plates 1.

According to the embodiment of FIG. 1, on the lower end of each ripple plate on both sides there is arranged a water collector channel 2, in which the water film is collected and transversely led away. Together both water collector channels 2 have a channel shaped upwardly opening semi-cylindrical cross-section which is attached at its center to or formed on the lowermost edge of each ripple plate, forming an integral or one-piece unit therewith; thereby, in a simple manner, a one-piece integral formation of both water collector channels 2 is possible with the ripple plate 1. The lowermost edge of each ripple plate constitutes substantially a maximum point M of a crest or trough, the slope of which is substantially vertical as indicated in dashed lines in FIGS. 1 and 2.

In accordance with the embodiment of FIG. 2, on the lower end of each ripple plate 1, a water collector groove 3 is formed which is bent off in a channel formed manner toward one side and the water film collects from one of the surfaces of the ripple plate 1. On the other side of the ripple plate 1 a further collector channel 4 is arranged, and indeed directly adjacent and above the lowermost corrugation. By this embodiment, which likewise makes possible a one-piece or integral formation of the water collector channels 3 and 4 with the ripple plate 1, there is produced a lower pressure drop or head loss for the cooling air when the latter is fed counter-flow to the water. The water collector channels 2, 3, 4 on the ripple plates 5 are not deep so that no standing or stagnant water occurs, but the water continuously flows and immediately passes into the water removal channel 8 without standing (FIGS. 3–5).

Figure 3:
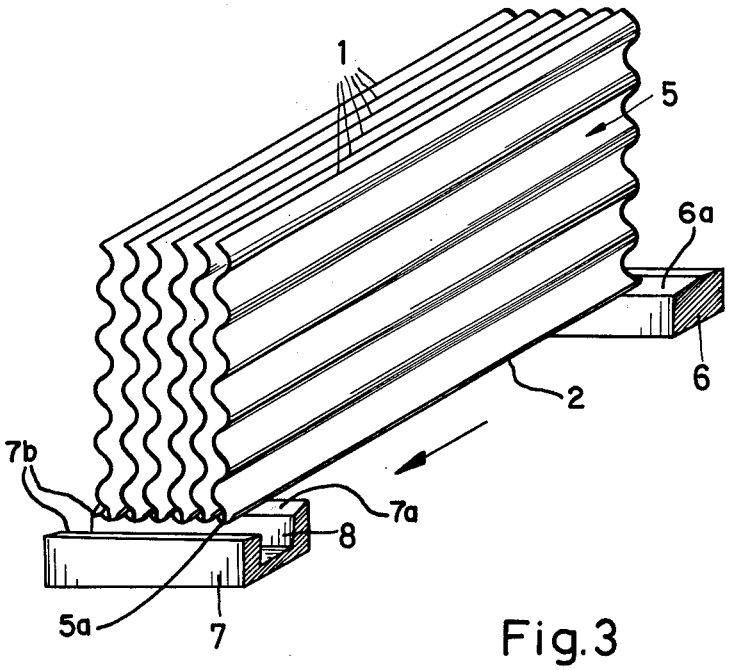
FIG. 3 is a perspective view of a portion of a cooling tower showing a portion of a ripple assembly element which is produced from ripple plates according to FIG. 1.

Referring now to FIG. 3, the mounting of a cooling stack or ripple plate assembly element 5 is shown. The ripple plate assembly element 5 is formed from the ripple plates 1 according to the embodiment of FIG. 1. The inclined support surface 6*a* of the lower lying transversely oriented, pentagonally shaped carrier member 6 lies slightly higher than the likewise inclined support surface 7*a* of the front transverse carrier member 7 so that the water collector channels 2 which are formed on the ripple plates 1 have a slope directed in descending manner toward the front as indicated by the arrow in FIG. 3 pointing to the front transverse carrier member 7 and overlap the inclined support surface 7*a* of the transverse carrier member 7 dipping into the water removal channel 8 at the forward front common side of the ripple assembly element. The cooling water emerging from the forward front common side of the ripple assembly element 5 is collected in the water removal channel 8, the latter being integrally formed in the front transverse carrier member 7 and constituting a part of the cooling water circuit 11 (FIG. 5).

The transverse carrier member 7 and water removal channel 8 are insubstantially lower than the lower edge of the water collector channels 2, 3. FIG. 3 shows that the face 7*a* of carrier member 7 which supports the plates 5 is also inclined (as is the surface 6*a* of member 6) so that the left hand edge 5*a* of the ripple plates 5 dips into the water removal channel 8 between the inner facing top edges 7*b* of the transverse carrier member 7. The channel 8 as well as its depth is insubstantially lower than the level of the water collector channels 2, 3, whereby the collected water is maintained substantially at its high level for subsequent direct pumping back to the distributor device 10 above the plates via the cooling water circuit 11.

Figure 4:
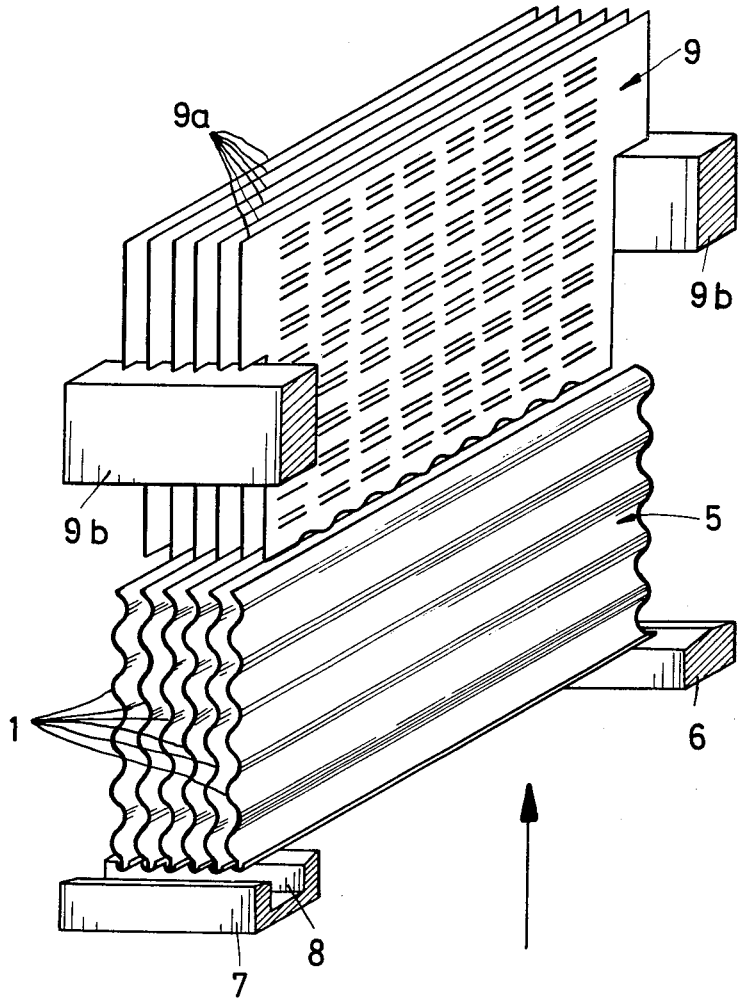
FIG. 4 is a perspective illustration corresponding to FIG. 3 in which the ripple assembly element is arranged in a counter-current cooling tower as the lower layer.
Figure 5:
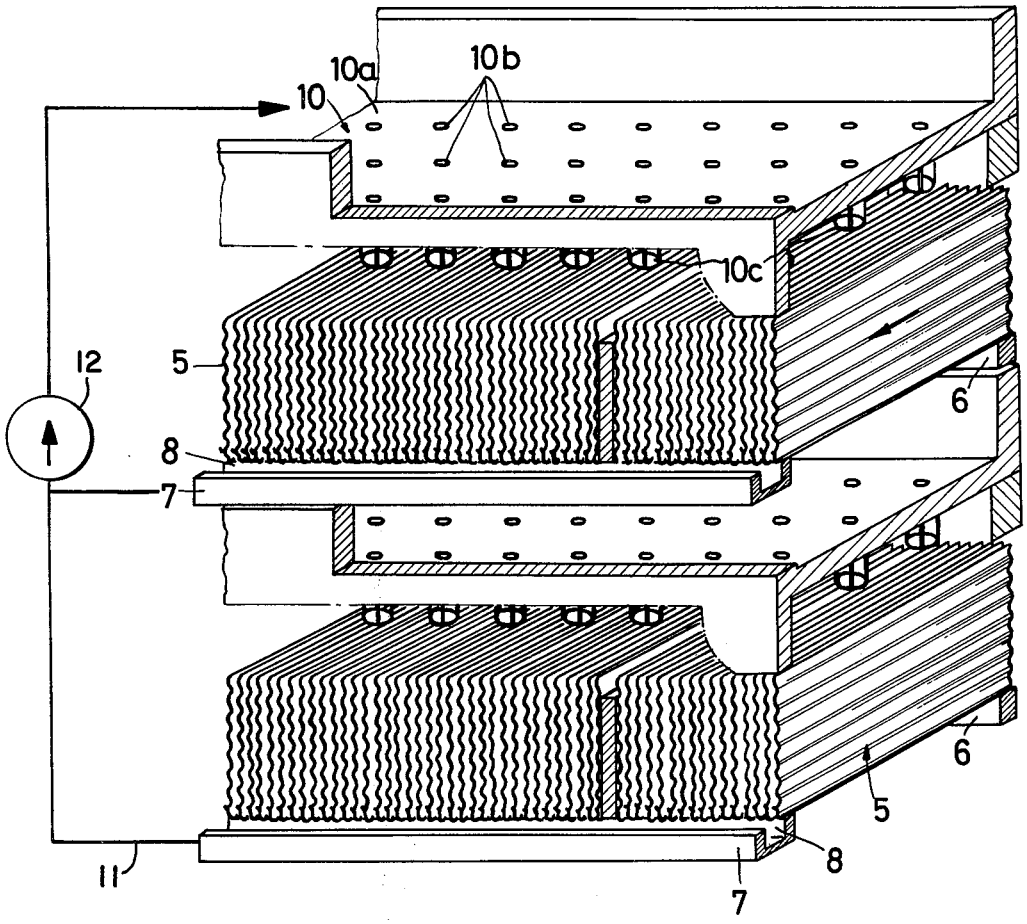
FIG. 5 is a perspective view of a cross-flow cooling tower with two stages or floors, which respectively are formed from ripple assembly elements with ripple plates according to FIG. 2.

In order to safely insure the collection of the cooling water which falls on the lower end of the ripple plate assemblies, it suffices in accordance with FIG. 4 of the drawings, if the lower layer of plural-layered ripple assemblies is formed from a ripple assembly element 5 in accordance with FIG. 3. This ripple assembly element 5 safely guarantees with the water collector channels 2 or 3 and 4, respectively, which are formed on the lower ends of the ripple plates 1, the collection of that water which is fed to the ripple assembly element 5 by an assembly element 9 lying thereabove, when this assembly element 9 is made of any chosen form of ripple plates 9*a*. In the illustrated embodiment the cooling air flows counter-current to the cooling water as indicated by means of the upwardly directed arrow in FIG. 4. The ripple plates 9*a* of the assembly element 9 are carried substantially in the center level by crossbars 9*b* supporting laterally flanged upper ends of the upper ripple plates 9*a*.

Referring now to the drawings and more particularly to FIG. 5, a section of a cross flow cooling tower is illustrated which has two assembly layers with ripple assembly elements 5. The ripple assembly elements 5 of each layer are carried by transverse girders or members 6 and 7, of which the front transverse member 7 is formed into a water removal channel 8. Consequently a layer-wise removal of the cooling water is possible. FIG. 5 also illustrates a distribution device 10 for the cooling water, which comprises a trough 10*a* which is U-shaped in cross-section, in which bores 10*b* are formed. The cooling water can emerge downwardly through the bores 10*b*. This cooling water arrives on a spray plate 10*c*, which is arranged spaced underneath the bores 10*b* and brings about a uniform distribution of the cooling water along the entire surface of the ripple assembly elements 5. The flow against the ripple assembly elements 5 occurs cross-wise to the flow direction of the cooling water, as indicated with an arrow in FIG. 5.

The flowing cooling water in the channels 2 and 3, respectively, and 4 is directly pumped from the water removal channels 8 via a pump 12 to the distribution device 10, or to a steam generator, without dropping substantially lower, via the cooling water circuit 11, which circuit 11 also includes the channels 8. That is, in any event the continuously flowing water from the water removal channels 8 is pumped in an absolutely completely closed circuit without the removal of water from the circuit.

This avoids a dropping loss, which heretofore occurred in conventional cooling towers when the cooling water dropped off from the lower ends of the ripple assembly elements into the water basin on the bottom of the cooling towers.

Figure 6:
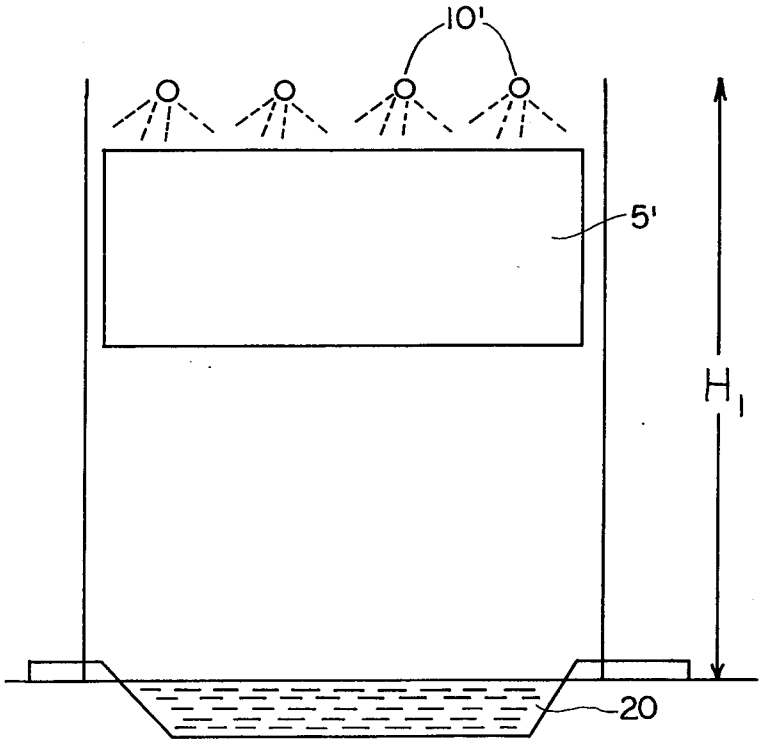
PRIOR ART FIG. 6

FIG. 6 illustrates such a prior conventional cooling tower which has a water basin 20 on the bottom. The water is sprayed from the distribution device 10' onto the ripple assembly elements 5'. The water rippling down on the ripple assembly elements 5' drops off from its lower edge in free-fall into this lower water basin 20. The pumping energy expended for feeding the cooling water back up to the distribution device 10' must consequently exceed the height $H_1$.

Figure 7:
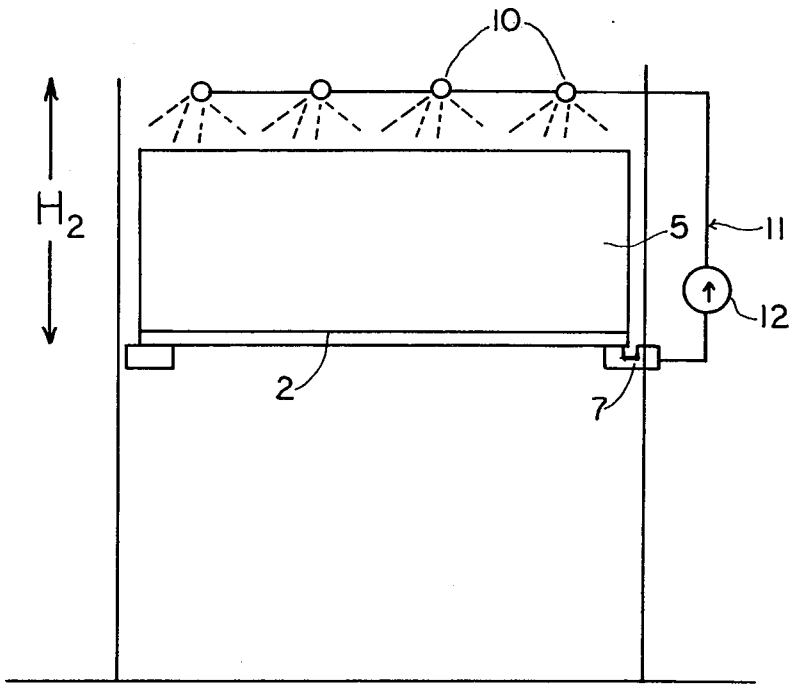
FIGS. 6 and 7 are schematic elevational views illustrating, respectively, the prior art energy loss in a cooling tower compared to the energy conservation which the present invention utilizes.

To the contrary the pumping energy with the cooling tower in accordance with the present invention merely must exceed the considerably smaller pumping height or level $H_2$ as illustrated in FIG. 7. With the present invention as in FIG. 7, namely the cooling water which is sprayed from the distribution device 10 onto the ripple assembly element 5 is collected at the lower end of the ripple plates of the assembly element 5 and consequently is pumped directly back to the distribution device 10 from the lower edge of the ripple assembly element 5. In this manner the pumping energy to be expended is fully, considerably reduced, for example by more than half.

The actual formation of the ripple assembly element 5 of the present invention is illustrated in further detail in FIGS. 3–5, in which FIG. 3 shows an arrangement only of one assembly of ripple plates 1; FIG. 4 illustrates two assemblies of ripple plates 1 and 9*a* one lying under the other, of which only the lower ripple plates 1 are constructed in accordance with the present invention, and FIG. 5 shows two assemblies of ripple plates 1, lying one above the other, each being formed in accordance with the present invention, so that with the embodiment according to FIG. 5 the invention is realized in double, one above the other.

While we have disclosed several embodiments of the present invention, these embodiments are given by example only and not in a limiting sense.

We claim:

1. A cooling tower having corrugated ripple plates for a substantially vertical assembly in wet cooling towers or combined wet-dry cooling towers in counter-flow construction, of which the portion at the upper end, the corrugation and the spacing relative to the respective adjacent equally-formed ripple plate are formed such that cooling water which is distributed from a distribution device above the ripple plates runs down on both surfaces of the ripple plates, respectively, as a substantially equal thickness water film, the latter being collected in water collector channels arranged at the lower ends of the ripple plates and being fed to a cooling water circuit, the improvement comprising at least one plurality of said substantially vertically oriented, corrugated ripple plates parallel to each other and each having substantially horizontally running corrugations comprising crests and troughs parallel to each other and substantially aligned in phase with said crests and troughs, respectively, of adjacent of said ripple plates, each of said ripple plates defining a lowermost portion having a lowermost edge, a water distribution device mounted above said plurality of ripple plates and for operatively spraying the water onto said ripple plates, means for collecting and permitting a continuous flow therein of the water which has run down said ripple plates at a level no lower than said lowermost edge comprising only one substantially horizontally extending said water collector channel integrally connected completely along each side of each of said ripple plates on said lowermost portion of each of said ripple plates, at least said water collector channel on one of the sides of each of said ripple plates constitutes said lowermost edge thereon, means for simultaneously removing the water in said water collector channels from at least one common side end of said ripple plates, said removing means constituting a support member supporting said one common side end of said ripple plates and defining a water removal channel therein extending substantially perpendicularly to said ripple plates and to said collector channels, respectively, disposed slightly lower than the level of said water collector channels and communicatingly connected therewith, and adapted to be fed therefrom to the cooling water circuit to said distribution device above said ripple plates.

two substantially horizontal transverse carrier members transversely oriented relative to said ripple plates, said two transverse carrier members exclusively support said ripple assembly element at said two common-side ends of said ripple assembly element, respectively, one of said transverse carrier members constitutes said first-mentioned support member and is formed with said water removal channel therein directly adjacent one of said common-side ends, the latter constituting said one common side end and constituting a common end of said water collector channels communicating with said water removal channel, said ripple assembly element is inclined toward said water removal channel, and said one transverse carrier member has an inclined support surface adjacent said water removal channel, respectively, said one common side end of said ripple plates is supported on said inclined support surface, respectively, and substantially overlaps the latter substantially dipping into said water removal channel.

2. The cooling tower as set forth in claim 1, wherein said at least one of said transverse carrier members is formed integrally with said water removal channel.

3. A cooling tower having corrugated ripple plates for a substantially vertical assembly in wet cooling towers or combined wet-dry cooling towers in counterflow construction, of which the portion at the upper end, the corrugation and the spacing relative to the respective adjacent equally-formed ripple plate are formed such that cooling water which is distributed from a distribution device above the ripple plates runs down on both surfaces of the ripple plates, respectively, as a substantially equal thickness water film, the latter being collected in water collector channels arranged at the lower ends of the ripple plates and being fed to a cooling water circuit, the improvement comprising at least one plurality of said substantially vertically oriented, corrugated ripple plates parallel to each other and each having substantially horizontally running corrugations comprising crests and troughs parallel to each other and substantially aligned in phase with said crests and troughs, respectively, of adjacent of said ripple plates, each of said ripple plates defining a lowermost portion having a lowermost edge, a water distribution device mounted above said plurality of ripple plates and for operatively spraying the water onto said ripple plates, means for collecting and permitting a continuous flow therein of the water which has run down said ripple plates at a level no lower than said lowermost edge comprising only one substantially horizontally extending said water collector channel integrally connected completely along each side of each of said ripple plates on said lowermost portion of each of said ripple plates, at least said water collector channel on one of the sides of each of said ripple plates constitutes said lowermost edge thereon, means for simultaneously removing the water in said water collector channels from at least one common side end of said ripple plates, said removing means constituting a support member supporting said one common side end of said ripple plates and defining a water removal channel therein extending substantially perpendicularly to said ripple plates and to said collector channels, respectively, disposed slightly lower than the level of said water collector channels and communicatingly connected therewith, and adapted to be fed therefrom to the cooling water circuit to said distribution device above said ripple plates, said at least one plurality of said ripple plates in parallel arrangement is combined into at least one ripple assembly element which is aligned and defines two common-side ends at said lowermost edge, two of said ripple assembly elements disposed one above the other, two of said distribution devices one disposed above each of said two ripple plate assemblies, respectively, said distribution devices each comprise a U-shaped upwardly opening trough formed with a plurality of uniformly distributed bores and a spray plate disposed under each of said bores spaced therefrom and above a top of said assembly elements, respectively.

4. The cooling tower as set forth in claim 3, including for each of said two ripple assembly elements, two substantially horizontal transverse carrier members transversely oriented relative to said ripple plates, said two transverse carrier members support said two common-side ends of each said ripple assembly element, respectively, one of said transverse carrier members constitutes said first-mentioned support member and is formed with said water removal channel therein directly adjacent one of said common-side ends, the latter constituting said one common side end and constituting a common end of said water collector channels communicating with said water removal channel, each said ripple assembly element is inclined relative to said water removal channel, respectively, the other of said two transverse carrier members respectively is solid and pentagonal in shape and has a first inclined support surface on which the other of said common-side ends of each said ripple assembly element is carried, respectively, said one transverse carrier member has a second inclined support surface adjacent said water removal channel, respectively, said one common side end of said ripple plates is supported on said second inclined support surface respectively and overlaps the latter dipping into said water removal channel.

5. The cooling tower as set forth in claim 3, wherein said water collector channels, respectively, on both sides of each of said ripple plates are offset in height relative to one another.

6. The cooling tower as set forth in claim 3, wherein at least one of said water collector channels on each of said ripple plates is formed in one-piece with said each of said ripple plates.

7. A cooling tower having corrugated ripple plates for a substantially vertical assembly in wet cooling towers or combined wet-dry cooling towers in counterflow construction, of which the portion at the upper end, the corrugation and the spacing relative to the respective adjacent equally-formed ripple plate are formed such that cooling water which is distributed from a distribution device above the ripple plates runs down on both surfaces of the ripple plates, respectively, as a substantially equal thickness water film, the latter being collected in water collector channels arranged at the lower ends of the ripple plates and being fed to a cooling water circuit, the improvement comprising at least one plurality of said substantially vertically oriented, corrugated ripple plates parallel to each other and each having substantially horizontally running corrugations comprising crests and troughs parallel to each other and substantially aligned in phase with said crests and troughs, respectively, of adjacent of said ripple plates, each of said ripple plates defining a lowermost portion having a lowermost edge, a water distribution device mounted above said plurality of ripple plates and for operatively spraying the water onto said ripple plates, means for collecting and permitting a continuous flow therein of the water which has run down said ripple plates at a level no lower than said lowermost edge comprising only one substantially horizontally extending said water collector channel integrally connected completely along each side of each of said ripple plates on said lowermost portion of each of said ripple plates, at least said water collector channel on one of the sides of each of said ripple plates is said lowermost edge thereon, means for simultaneously removing the water in said water collector channels from at least one common side end of said ripple plates, said removing means constituting a support member supporting said one common side end of said ripple plates and defining a water removal channel therein extending substantially perpendicularly to said ripple plates and to said collector channels, respectively, disposed slightly lower than the level of said water collector channels and communicatingly connected therewith, and a closed removal channel extending therefrom directly to the distribution device and pump means for feeding the water from the water collector channels through said cooling water circuit directly back up to the distribution device above said ripple plates without the water going substantially lower, said at least one plurality of said ripple plates in parallel arrangement is combined into at least one ripple assembly element which is aligned and defines two common-side ends at said lowermost edge, two substantially horizontal transverse carrier members transversely oriented relative to said ripple plates, said two transverse carrier members support said two common-side ends of said ripple assembly element, respectively, and one of said transverse carrier members constitutes said first-mentioned support member and is formed with said water removal channel therein directly adjacent one of said common-side ends, the latter constituting said one common side end and constituting a common end of said water collector channels communicating with said water removal channel, said ripple assembly element is inclined relative to said water removal channel, the other of said two transverse carrier members is solid and pentagonal in shape and has a first inclined support surface on which the other of said common-side ends of said ripple assembly element is carried, said one transverse carrier member has a second inclined support surface adjacent said water removal channel, said one common side end of said ripple plates is supported on said second inclined support surface and overlaps the latter dipping into said water removal channel, two of said ripple assembly elements disposed one above the other, two of said distribution devices one disposed above each of said two ripple plate assemblies, respectively, said distribution devices each comprise a U-shaped upwardly opening trough formed with a plurality of uniformly distributed bores and a spray plate disposed under each of said bores spaced therefrom and above a top of said assembly elements, respectively.

* * * * *